US005356303A

United States Patent [19]

Shibata et al.

[11] Patent Number: 5,356,303

[45] Date of Patent: Oct. 18, 1994

[54] AUTOMATIC PLUG-IN CONNECTING APPARATUS

[75] Inventors: Susumu Shibata; Yuichi Fujita; Kazumi Shima, all of Chiba; Makoto Wada, Tokyo, all of Japan

[73] Assignee: Toyo Engineering Corporation, Tokyo, Japan

[21] Appl. No.: 111,127

[22] Filed: Aug. 24, 1993

[30] Foreign Application Priority Data

Sep. 11, 1992 [JP] Japan ..... 4-243315
Dec. 22, 1992 [JP] Japan ..... 4-340821

[51] Int. Cl.[5] ..... H01R 13/52
[52] U.S. Cl. ..... 439/198; 439/184
[58] Field of Search ..... 439/184, 189, 198, 199, 439/201, 205, 206, 310

[56] References Cited

U.S. PATENT DOCUMENTS 4,073,562 2/1978 Karlskind ..... 439/199
4,302,064 11/1981 Spinner ..... 439/198
4,363,168 12/1982 Bryer et al. ..... 439/201 X
4,828,507 5/1987 Nagase et al. ..... 439/206
5,194,012 3/1993 Cairns ..... 439/201

FOREIGN PATENT DOCUMENTS 1528351 10/1978 United Kingdom ..... 439/178

*Primary Examiner*—Z. R. Bilinsky
*Attorney, Agent, or Firm*—Fisher & Associates

[57] ABSTRACT

An automatic plug-in connecting unit having small weight, capable of automatically connecting and disconnecting an electric current supply line, and satisfying the conditions for a ventilated type pressurized type explosion-protected construction or a sealed type pressurized type explosion-protected construction includes an automatic plug-in connecting apparatus having a supply side connecting unit provided with an electrically connecting socket contact which is buried in one end portion thereof, and which serves also as an air vent, a reception side connecting unit provided with a pin contact forming a counterpart of the said socket, a means for connecting and disconnecting the socket contact and pin contact to and from each other, and an engagement guide, characterized by a clean gas supply means for turning the atmosphere around the socket contact and pin contact into a clean gas atmosphere when these contacts are connected or disconnected by combining the supply side connecting unit with the reception side connecting unit, a connection detecting means for ascertaining the connection of the supply side connecting unit to the reception side connecting unit, a supplied clean gas detecting means adapted to sense the presence or absence of a clean gas supplied to the interior of the supply side connecting unit, and a current supply control means for controlling the supplying of an electric current from a power source in accordance with the operations of the connection detecting means and supplied clean gas detecting means.

6 Claims, 9 Drawing Sheets

15
8b
13
9
12
14
a
7
3
2
7
E
3a
F
4
A
1
11
5
6
D
C

B
12
14
7
13
9
7
15
8b
8b
3a
3a
E
3
2
F
4
A
1
11
5
6
D
C

RECEPTION SIDE CONNECTING UNIT
SUPPLY SIDE CONNECTING UNIT
DRIVING MEANS
A
C
D
E
F
1
2
3
3a
4
5
7
8
8b
9
11
12
13
15
17
18
19

RECEPTION SIDE CONNECTING UNIT
SUPPY SIDE CONNECTING UNIT
DRIVING MEANS
A
C
D
E
F
1
2
3
3a
4
5
7
8
8b
9
11
12
15
18
19

AUTOMATIC PLUG-IN CONNECTING APPARATUS

BACKGROUND OF THE INVENTION

1. Field of the Invention

This invention relates to an automatic plug-in connecting apparatus for supplying an electric current from a power source, capable of being used in a hazardous area for explosive gas atmosphere, for example, a combustible and inflammable gas atmosphere.

2. Description of the Prior Art

As the automation of machines and the saving of human power have progressed in the general industrial field, a demand that the connection and disconnection of a power source current supply line be carried out automatically has increased, and various types of automatically detachable plug-in connecting apparatuses have been developed and put to practical use. However, an automatically detachable plug-in connecting apparatus of an explosion-protected construction capable of being used in such a hazardous area as mentioned above is still under development.

Although a plug socket of a flame-proof type explosion-protected construction has heretofore been sold on the market as a device for connecting a machine to a power source current supply line in such an explosive gas atmosphere as mentioned above, it cannot be utilized as an automatic connection and disconnecting device since it carries a high price and large weight, and since it is designed with a dust-proof cap. Additionally, the centering of a plug and socket as well as the fixing of the plug and socket union must be carried out manually.

SUMMARY OF THE INVENTION

The most important condition that an automatic plug-in connecting apparatus used in the above-mentioned explosive gas atmosphere has to satisfy is that the apparatus neither catches on fire nor causes explosions. The constructions satisfying such conditions are classified in "Recommended Practice for Explosion-Protected Electrical Installations in General Industries" (Research Institute of Industrial Safety of the Ministry of Labor) (JAPAN) into intrinsically safe type explosion-protected construction, flame-proof type explosion-protected construction, increased safety type explosion-protected construction, oil-immersed type explosion-protected construction and special type explosion-protected construction, and the prescriptions concerning the structure and performance of each type given.

Among these types, the pressurized type explosion-protected constructions are designed so that the internal pressure thereof is retained by filling under pressure the interior thereof, i.e., the inner space of electrical machines with a protective gas, such as clean air or an inert gas so as to prevent the entry of an explosive gas existing outside and substantially shut off and isolate the interior from a hazardous gas atmosphere. The systems for retaining the internal pressure of such construction include a ventilated type system and a sealed type system.

An object of the present invention is to provide an automatic plug-in connecting apparatus having small weight; capable of automatically connecting and disconnecting an power source supply line; and satisfying the prescriptions concerning the ventilated type pressurized type explosion-protected construction or sealed type pressurized type explosion-protected construction as given in the above-mentioned "Recommended Practice for Explosion-Protected Electrical Installations in General Industries".

BRIEF DESCRIPTION OF THE DRAWINGS

The invention will be further described in conjunction with the accompanying drawings, in which.

DETAILED DESCRIPTION OF THE PREFERRED EMBODIMENT

Figure 1:
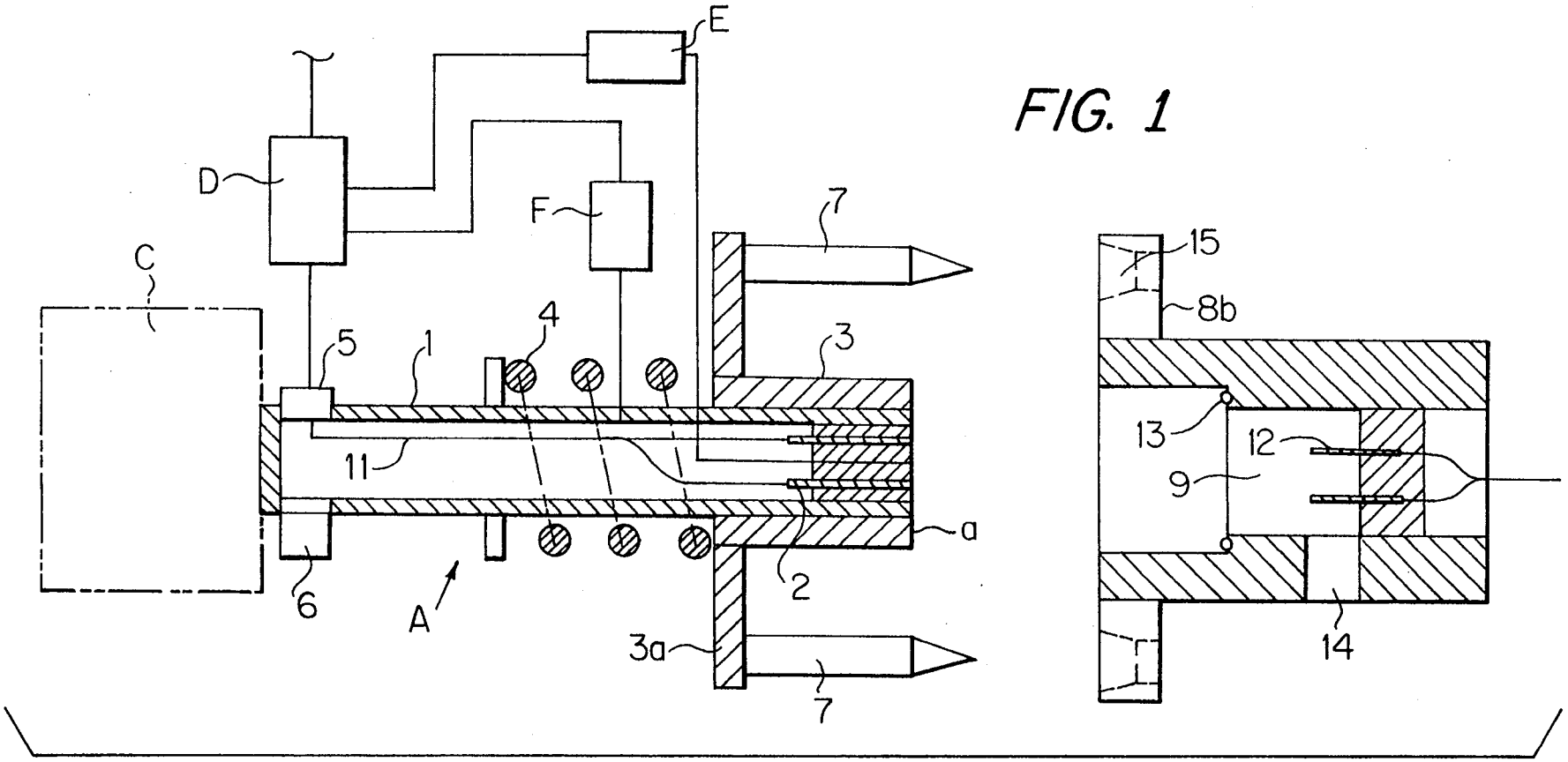
FIG. 1 is a sectioned side elevation of an embodiment of the automatic plug-in connecting apparatus according to the present invention.

The automatic plug-in connecting apparatus according to the present invention is formed by a structure which includes a supply side connecting unit provided at one end portion thereof with an electrical connecting socket contact buried therein and serving also as an air vent, and at the other end portion thereof with an outlet port for taking out therefrom an electric wire connection to the socket contact and an inlet portion for introducing a non-explosive clean or inert gas thereinto. A reception side connection unit is provided at one end portion thereof with a hollow for receiving the supply side connecting unit, and at the rear side portion of the receiving hollow with a discharge port for discharging therefrom a gas in the receiving hollow and a space communicating therewith and a pin contact forming a counterpart of the socket contact. A supply side connecting unit driving means is provided for fitting the supply side connecting unit into the receiving hollow of the reception side connecting unit so as to connect or disconnect the socket contact and pin contact to or from each other. An engagement guide includes guide pins provided on either one of the supply side connecting unit and reception side connection unit and pin receiving bores provided in the other thereof, and which smooths an operation for fitting the supply side connection unit into the receiving hollow of the reception side connection unit. An inert or clean gas supply means for forming an inert or clean gas atmosphere in a space in the vicinity of the socket contact and pin contact when the contacts are connected and disconnected to and from each other by connecting the supply side connecting unit to reception side connecting unit. A connection detecting means is included for ascertaining the connection of the supply side connecting unit to the reception side connecting unit. A supplied clean or inert gas detecting means is adapted to sense the presence or absence of a clean or inert gas supplied to the interior of the supply side connecting unit, and a current supply control means is operatively connected to the connecting detecting means and supplied clean or inert gas detecting means and adapted to control the supply of an electric current from a power source. Alternatively, the automatic plug-in connecting apparatus which includes the above described structure may further include a means for closing the discharge port at the time of completion of the connection of the socket contact with the pin contact so as to turn the receiving hollow into a closed space.

In operation when a socket contact and a pin contact are connected together by combining a supply side connecting unit and a reception side connecting unit with each other, the space around the socket contact may always be kept in a clean or inert gas atmosphere by supplying a clean gas to the interior of an inner cylinder and working an air vent of the socket contact as a gas discharge port.

The automatic plug-in connecting apparatus according to the present invention is further provided with an engagement guide referred to above. Therefore, when the supply side connecting unit and reception side connecting unit are combined with each other, the guide pins are inserted into the pin receiving bores, and the axes of the projecting and recessed faucet joints are aligned with each other, so that the faucet joint engaging and disengaging operation may be carried out smoothly and reliably.

The automatic plug-in connecting apparatus according to the present invention is further provided with a connection detecting means for ascertaining the connection of the supply side connecting unit to the reception side connecting unit, a supplied clean or inert gas detecting means adapted to sense the presence or absence of a clean or inert gas supplied to the interior of the inner cylinder, and a current supply control means operatively connected to the connection detecting means and supplied clean or inert gas detecting means and adapted to control the supply of an electric current from a power source. Therefore, when the combining of the projecting faucet joint with the recessed faucet joint has been completed, the driving of the supply side connecting unit by the connect-separating means is stopped temporarily; and the engagement of the supply side connecting unit with the reception side connecting unit is ascertained by the connection detecting means; or a clean or inert gas is supplied to the space in the reception side connecting unit to turn the same space to a clean or inert gas atmosphere. The supply side connecting unit is then driven again as the continuation of the supply of the clean or inert gas to the mentioned space is ascertained by the clean or inert gas detecting means, to insert and combine the pin contact into and with the socket contact in a power-off condition. After the engagement operation is finished, the supplying of an electric current by the current supply control means is started to complete the connection of the connecting units. Even while the contacts are connected together, the space around the contacts may always be kept in a clean or inert gas atmosphere by maintaining the pressure in the connecting apparatus higher then that of the exterior thereof. While the contacts are connected together, the supplying of the clean or inert gas is monitored by the supplied clean or inert gas detecting means.

In the apparatus according to the present invention which is provided additionally with a means for closing the receiving hollow by closing the discharge port at the time of completion of the connection the socket contact with the pin contact. The space around the contacts is turned to a closed space at the mentioned time even while the contacts are connected together. Thus, the space around the contacts may always be kept in a clean or inert gas atmosphere by maintaining the pressure in the connecting apparatus higher than that of the exterior atmosphere by using a small amount of clean gas supplied to the space.

DETAILED DESCRIPTION OF THE PREFERRED EMBODIMENT

Figure 2:
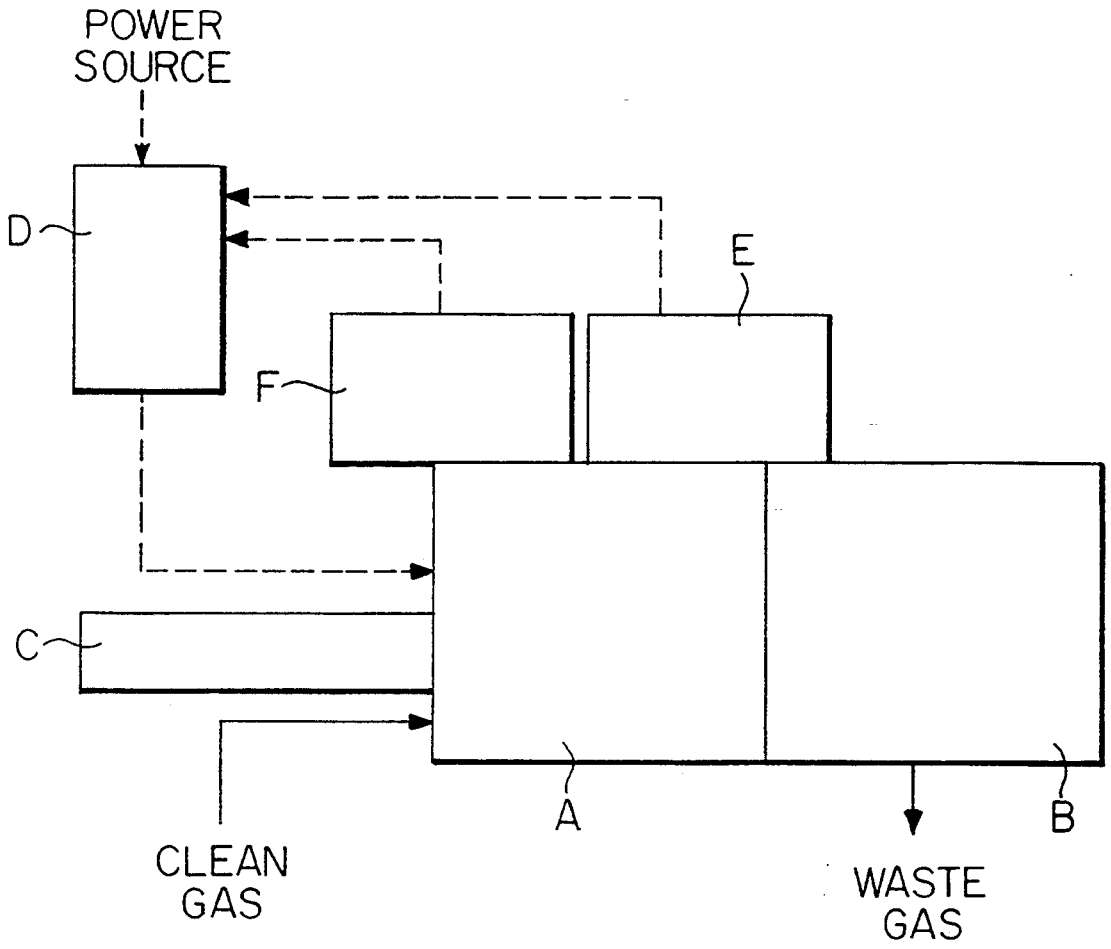
FIG. 2 is a block diagram showing the outline of the automatic plug-in connecting apparatus of FIG. 1.

An embodiment of the present invention will now be described in detail with reference to the drawings. FIGS. 1 and 2 illustrate an embodiment of the automatic plug-in connecting apparatus according to the present invention, wherein FIG. 1 is a sectioned side elevation of the same apparatus; and FIG. 2 a block diagram showing the outline thereof. As shown in the block diagram of FIG. 2, this embodiment of the automatic plug-in connecting apparatus includes a supply side connecting unit A, a reception side connecting unit B, a supplyside connecting unit driving means C, a current supply control means D, a connection detecting means E, a supplied clean or inert gas detecting means F, a power source current supply means (not shown) and a clean or inert gas supply means (not shown).

As shown in FIG. 1, the supply side connecting unit A includes an inner cylinder 1, provided at one end portion thereof with an air vent-carrying socket contact 2 fixed thereto. At the other end portion of inner cylinder 1 is an outlet port 5 for withdrawing a power source cable 11 therefrom and an inlet port 6 for introducing a clean or inert gas therein. An outer cylinder 3 having a length smaller than that of the inner cylinder 1 is fitted around the inner cylinder 1 so that the inner cylinder 1 may be slidingly moved therein. Outer cylinders has at a base end portion thereof a flange 3*a* with guide pins 7 and a projecting faucet joint 3*b* at a free end portion thereof. A spring member 4 is provided on the outer circumferential surface of the inner cylinder 1 and adapted to apply to flange 3*a* a force directed from the base end of outer cylinder 3 toward the free end portion thereof so as to keep an outer end surface of socket contact 2 and a corresponding end surface of projecting faucet joint 3*b* of outer cylinder 3 flush with each other.

Figure 3:
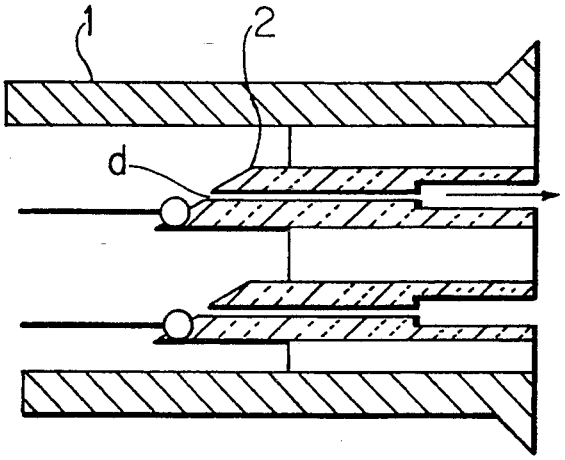
FIG. 3 is an enlarged section around socket contact designated by a reference numeral 2 in FIG. 1, this drawing being prepared so as to illustrate an inert gas introducing means provided at the free end portion of an inner cylinder designed by a reference numeral in FIG. 1.

As shown in FIG. 3, socket contact 2 is provided therein with a through air vent d as a clean or inert gas introducing means. When a clean or inert gas is supplied to the interior of the inner cylinder 1, through an introduction portion 6, the gas is discharged from the air vent d. Thus, the space around socket contact 2 is always kept in a clean or inert gas atmosphere. One end of each of power source cables 11 is connected to an end portion of socket contact 2. The other ends of the power source cables are withdrawn from outlet port 5 to the outside of supply side connection unit A and connecting to current supply control means D. A supply side connecting unit driving means C (consisting typically of an air cylinder) for moving the supply side connection unit A, as a whole, linearly toward the reception side connecting unit B will be described later. Driving means C combines the supply side connecting unit A and reception side connecting unit B with each other and is connected to inner cylinder 1. The clean gas consists of a non-explosive gas, for example, an inert gas such as nitrogen, and an element of air not containing an explosive gas.

The reception side connecting unit B consists of a recessed faucet joint 8 which defines a hollow in which the projecting faucet joint 3*b* of the outer cylinder 3 is to be fitted. A flange 8*b* is formed on the circumferential edge of an engaging mouth of recessed faucet joint 8 so as to be opposed to flange 3*a* of outer cylinder 3. A receiving hollow 9 is formed continuously from and at the back in the faucet joint-engaging direction of recessed faucet joint 8 and consists of a round cavity for receiving inner cylinder 1 forced out from outer cylinder 3. Finally, a pin contact 12 is provided in receiving hollow 9 and forms the counterpart of socket contact 2 in inner cylinder 1. An O-ring 13 consisting of a flexible material, such as rubber, is provided on the end surface of recessed faucet joint 8 which contacts end surface a of outer cylinder 3 when recessed and projecting faucet joints 8, 3*b* are engaged with each other. O-ring 13 enables the interior of receiving hollow 9 to be isolated from the outside atmosphere. The wall of receiving hollow 9 is provided with a discharge port 14 for discharging therefrom a gas in recessed faucet joint 8 which communicates with hollow 9. A pin contact 12 forms the counterpart of socket contact 2 and is supported behind discharge port 14. A pipe communicating with the discharge port 14 is joined thereto as necessary, and the pipe serves as a clean gas discharge line. Flange 8*b* is provided with pin receiving bores 155 which are counterparts of guide pins 7 of supply side connection unit A. Thus, when supply side connecting unit A and reception side connecting unit B are combined with each other, guide pins 7 may be inserted into pin receiving bores 15 to enable the axes of projecting and recessed faucet joints 3*b*, 8 to be aligned with each other and faucet joint fitting and removing operations to be carried out smoothly and reliably.

The current supply control means D is a device interposed between a power source current supply means and supply side connecting unit. Control means D is adapted to control the supplying of an electric current from the power source current supply means to supply side connecting unit A on the basis of information from connection detecting means E and supplied clean gas detecting means F, both of which will be described below. Connection detecting means E is a device adapted to detect whether inner cylinder 1 is in a predetermined position. This is accomplished by a limit switch, which ascertains the connection of supply side connecting unit and reception side connecting unit together. When a signal of ascertainment of this connection is sent to current supply control unit D, current supply control unit D starts supplying an electric current to supply side connecting unit A. Supplied clean gas detecting means F has an interlocking system adapted to monitor the presence or absence of a supplied clean gas by detecting the internal pressure of inner cylinder 1. Additionally, detecting means F senses when the supply of a clean gas should stop, i.e., a decrease of the internal pressure of the inner cylinder. A signal representative of this decrease in pressure is sent to current supply control means D which then cuts off the supply of an electric current to supply side connecting unit A.

Figure 4:
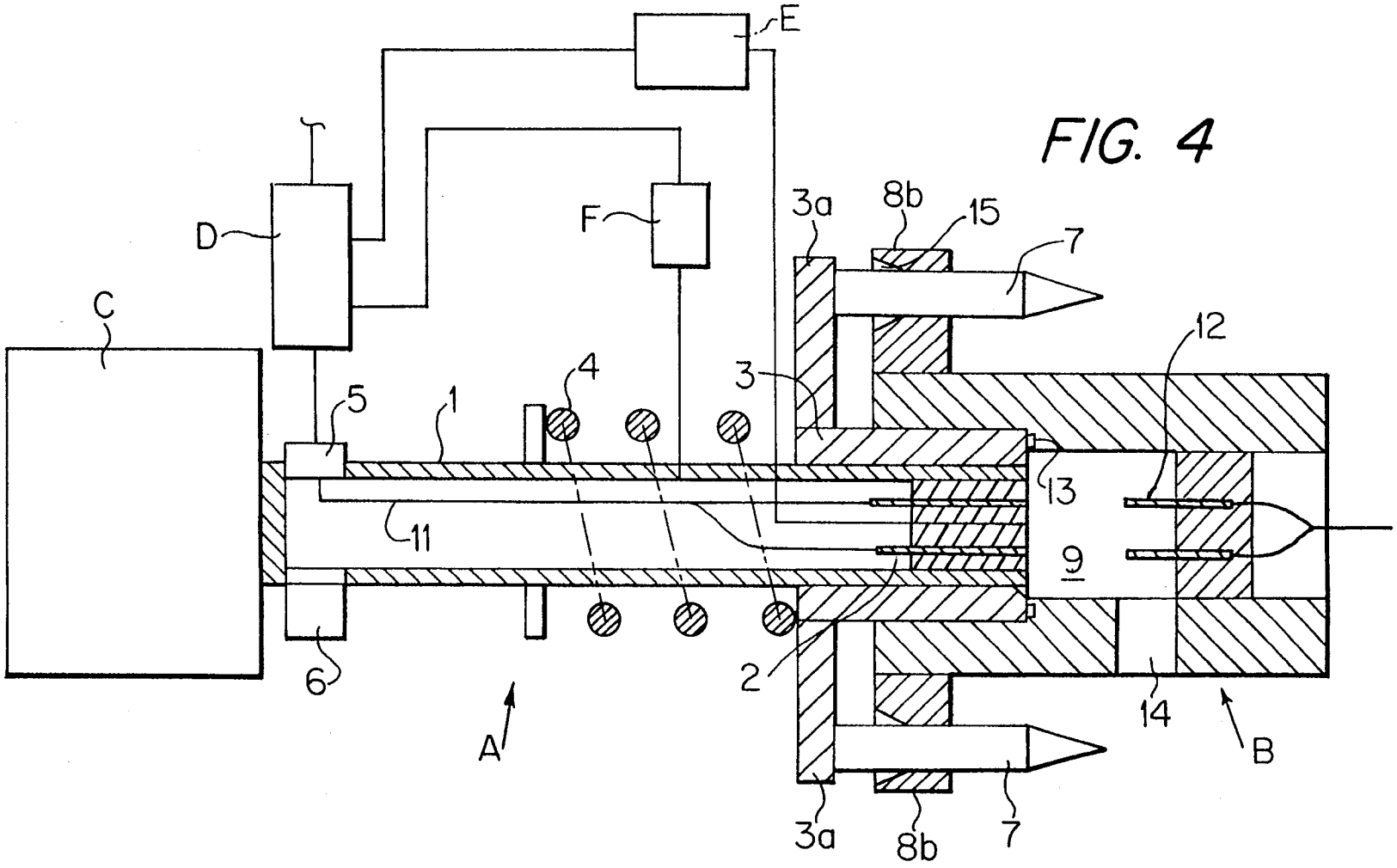
FIG. 4 is a drawing showing an outer cylinder 3 inserted into and combined with a recessed faucet joint with a supply side connection unit A brought close to a reception side connecting unit B by a supply side connection unit driving means C; this drawing being prepared so as to illustrate an operation for connection and disconnecting the contacts of a power source line by using the automatic plug-in connecting apparatus in this embodiment.
Figure 5:
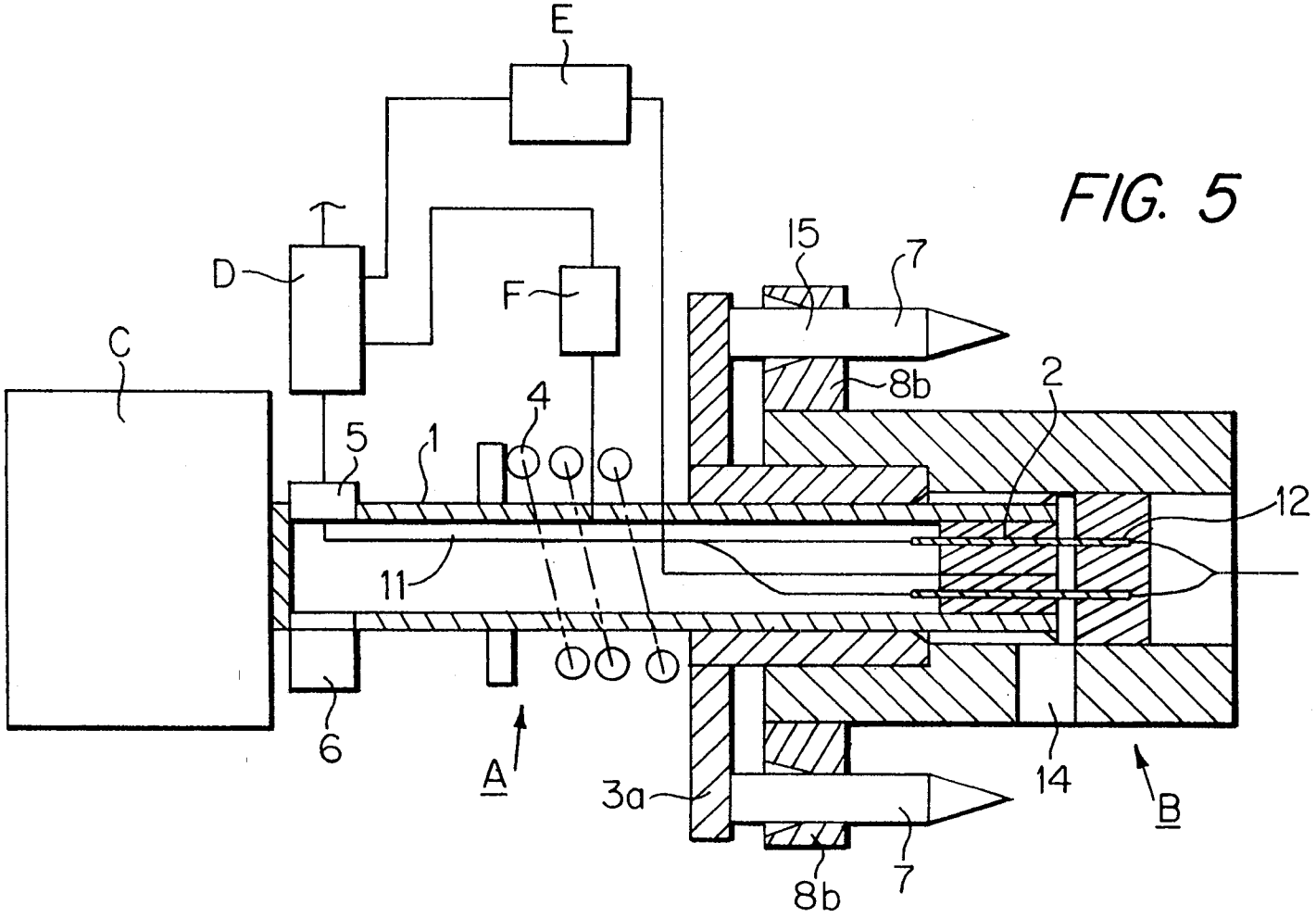
FIG. 5 is a drawing showing a pin contact inserted into and combined with a socket contact by forcing out an inner cylinder into the interior of a receiving hollow; this drawing being prepared so as to illustrate an operation for connecting and disconnecting the contacts of a power source line by using the automatic plug-in connecting apparatus, in this embodiment, FIG. 6 a sectioned side elevation of Example 2 of the automatic plug-in connecting apparatus according to the present invention.

Automatic plug-in connecting apparatus in this embodiment, supply side connecting unit A, shown in FIG. 1, is brought close to reception side connecting unit B by supply side connecting unit driving means C. While supply side connecting unit A is moved toward reception side connecting unit B, the axes of projecting faucet joint 3*b* of outer cylinder 3 and recessed faucet joint 8 of reception side connecting unit B are aligned with each other by the guide pins 7 and pin receiving port 15. Additionally, outer cylinder 3 is inserted into and combined with recessed faucet joint 8. During this time, the end surface a of outer cylinder 3 contacts O-ring 13 under pressure to cause the interior of the receiving hollow 9 to be isolated from the atmosphere. This condition is shown in FIG. 4. The movement of supply side connecting unit A is then stopped temporarily and a clean gas, the volume of which is at least five times as large as that of the receiving hollow 9, is supplied to the interior of the receiving hollow 9. The gas is supplied through air vent d of socket contact 2 to discharge the explosive gas, which resides in receiving hollow 9, from discharge port 14 and thus turning the interior of receiving hollow 9 into a clean gas atmosphere. The residual explosive gas is discharged through the line, which is connected to discharge port 14 to a non-hazardous area. When this gas substituting operation has been completed, the driving of supply side connecting unit A is restarted. Since outer cylinder 3 is urged against reception side connecting unit B at this time, inner cylinder 1 is forced out into receiving hollow 9. Thus, pin contact 12 is inserted into and combined with socket contact 2. This condition is shown in FIG. 5.

At this time, connection detecting means E detects if inner cylinder 1 is in a predetermined position by a limit switch provided on the end surface of the inner cylinder 1. Detecting means E also ascertains whether supply side connecting unit and reception side connecting unit are together. While the condition which allows to turn on an electric current is satisfied by both signals from connection detecting means E and supplied clean gas detecting means F, the supplying of an electric current is started by current supply control means D. Since the clean gas continues to be supplied constantly to the interior of receiving hollow 9 even after the power source current has started being supplied, the space around socket contact 2 and pin contact 12 is always kept in a clean gas atmosphere. Supplied clean gas detecting means F is provided with an interlocking system adapted to monitor the supplying of a clean gas by detecting the internal pressure of inner cylinder 1. Detecting means F also cuts off the supply of a power source current when the supply of a clean gas stops.

In the automatic plug-in connecting apparatus in this embodiment, the space around socket contact 2 and pin contact 12 may be kept in a clean gas atmosphere at all times during a connecting unit engaging operation. Additionally, socket contact 2 and pin contact 12 are joined together by an insert-combining operation in a power-off condition as described above. This enables an electrical connecting operation to be carried out very safely. Since the space around socket 2 and pin contact 12 is always kept in a clean gas atmosphere, under pressure even while a power source current is supplied, the requirements for a pressurized type explosion-protected construction are completely satisfied.

Figure 6:
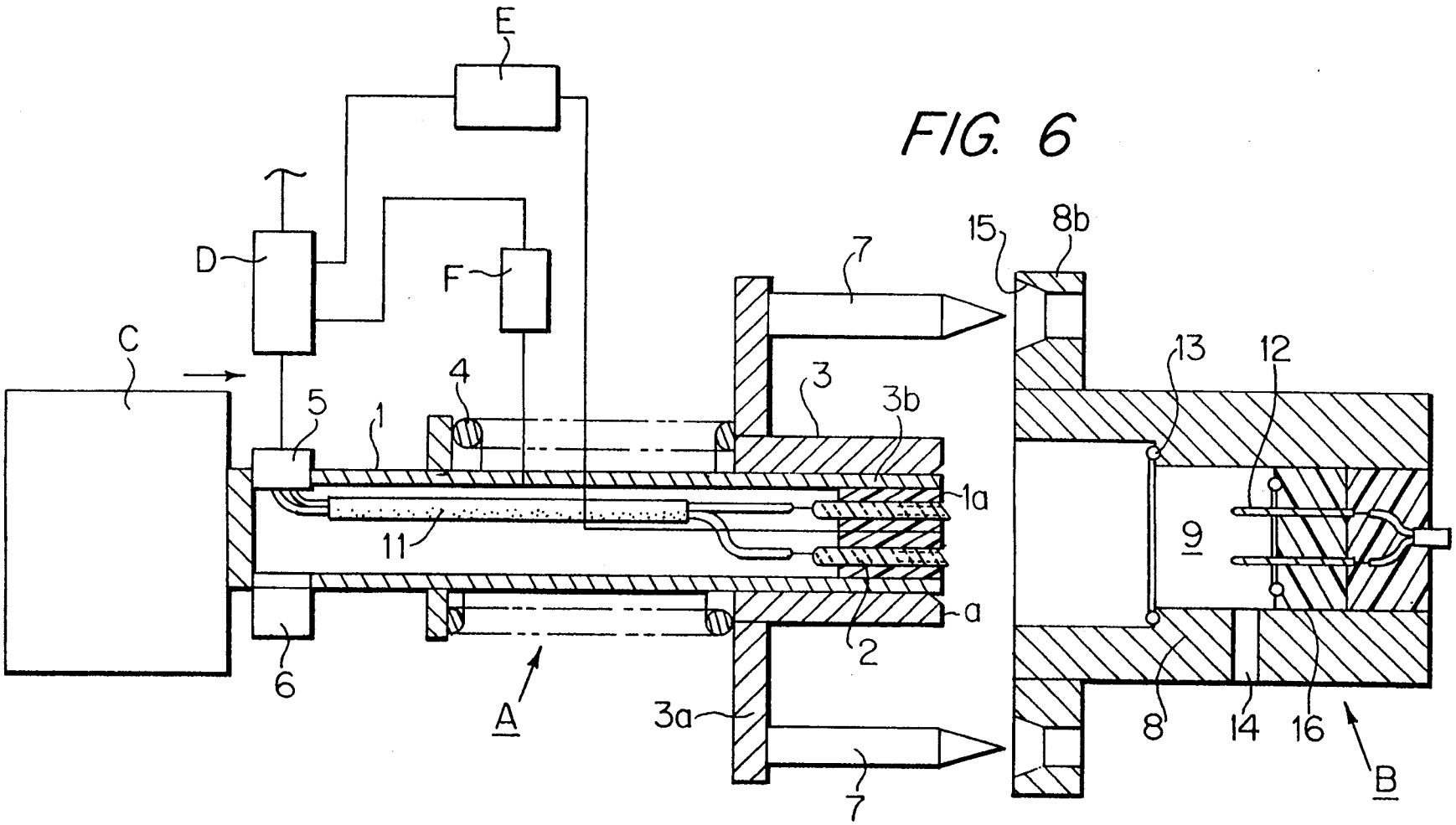

FIG. 6 shows another embodiment of the automatic plug-in connecting apparatus according to the present invention. The structural parts of this embodiment which are identical with those of the previously described automatic plug-in connecting apparatus of Example 1 are designated by the same reference numerals, and the descriptions thereof are omitted. As shown in FIG. 6, the automatic plug-in connecting apparatus is provided with an O-ring 16, which consists of a flexible material, such as rubber. O-ring 16 is affixed to a pin mounting surface opposed to an end surface 1*a* of an inner cylinder 1 so that a receiving hollow 9 may be shut off from discharge port 14 while socket contact 2 and pin contact 12 are combined with each other. This structure enables receiving hollow 9 to be a closed space. The remaining parts of the structure are completely the same as the corresponding parts of the automatic plug-in connecting apparatus in Example 1. The automatic plug-in connecting apparatus in this embodiment may be minimized.

Figure 7:
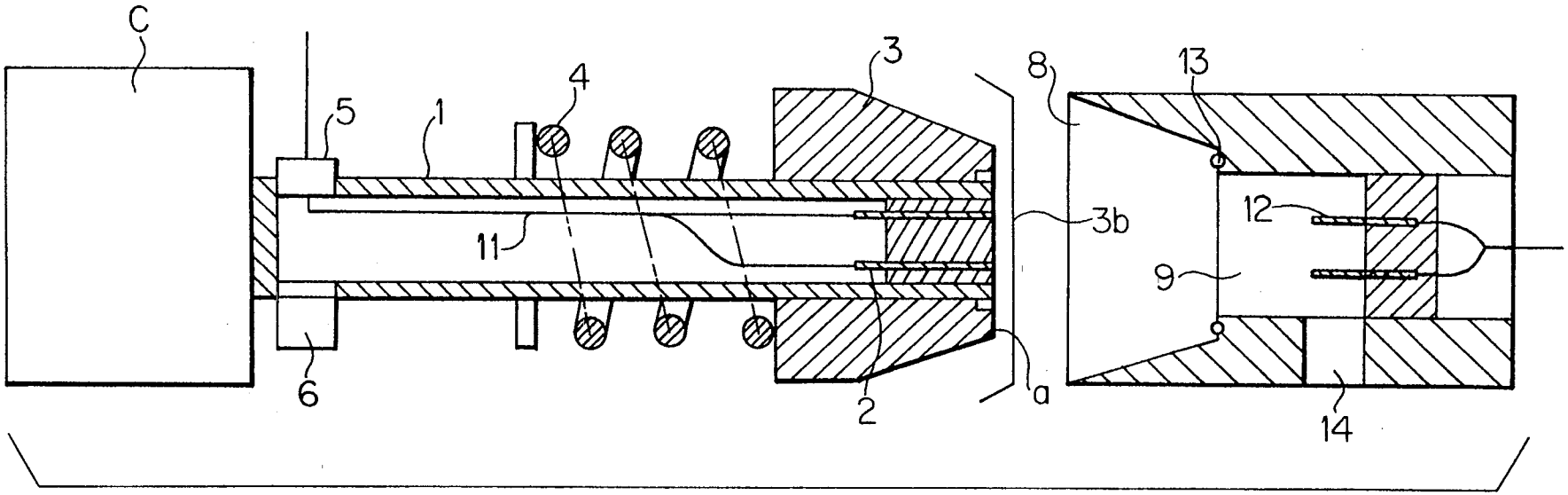
FIG. 7 is a sectioned side elevation of Example 3 of the automatic plug-in connecting apparatus according to the present invention.

FIG. 7 shows still another embodiment of the automatic plug-in connecting apparatus according to the present invention. The structural pans of this embodiment which are identical with those of the previously-described automatic plug-in connecting apparatus of Example 1 are designated by the same reference numerals, and the descriptions thereof are omitted. As shown in FIG. 7, the automatic plug-in connecting apparatus has a frusto-conically contoured outer cylinder 3, and a cone-shaped recessed faucet joint 8 of a reception side connecting unit B which may be fitted around frusto-conical outer cylinder 3. Thus, outer cylinder 3 is additionally provided with the function of guide pins 7 in Example 1. Also, recessed faucet joint 8 of the reception side connecting unit B is provided with the function of pin receiving bores 15 in Example 1. The construction of the remaining parts of this embodiment is completely the same as that of the corresponding parts of the automatic plug-in connecting apparatus of Example 1. This embodiment has an identical effect as that of the previously-described Example 1. In addition, flange 3*a*, from forming guide pins 7 thereof, and flange 8*a* for, forming the pin receiving bores 15 therein, may be omitted. This enables an automatic plug-in connecting apparatus to be miniaturized.

Figure 8:
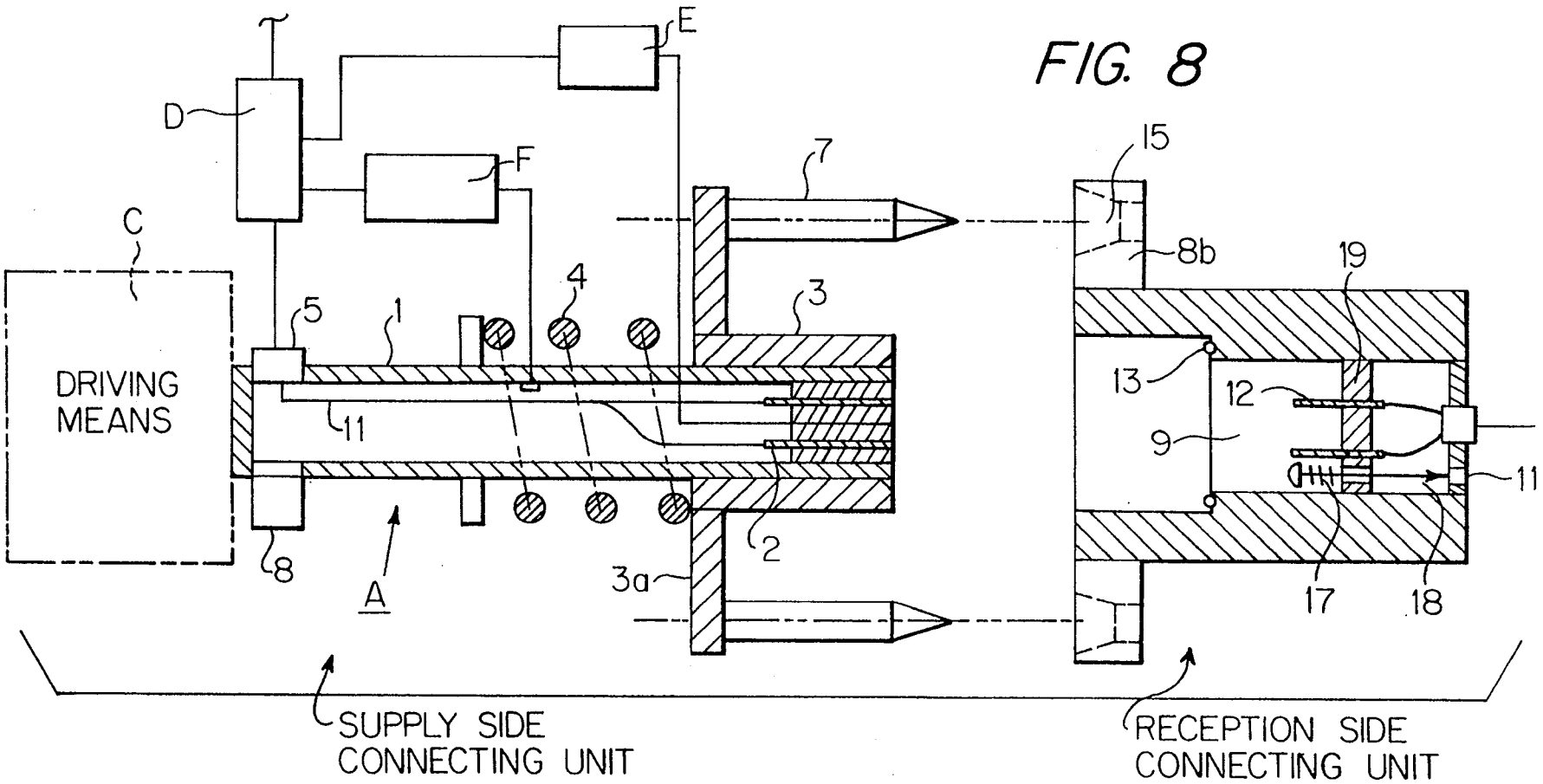
FIG. 8 is a sectioned side elevation of Example 4 of the automatic plug-in connecting apparatus according to the present invention.
Figure 9:
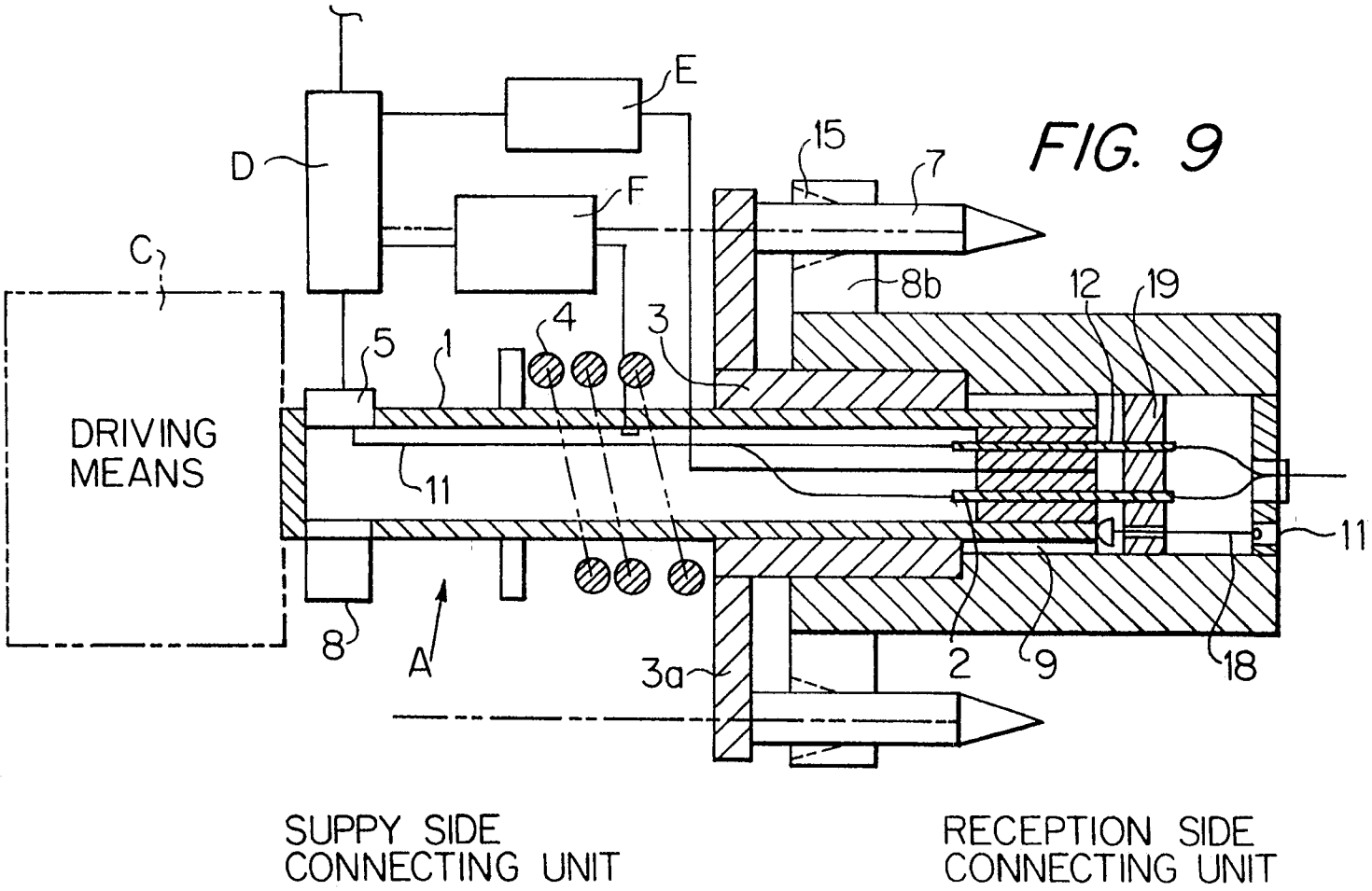
FIG. 9 is a sectioned side elevation showing the condition of a pin contact inserted into and combined with a socket contact by forcing an inner cylinder into a receiving hollow; this drawing being prepared for illustrating an operation for connecting and disconnecting the contacts in a power source line in Example 4 of the automatic plug-in connecting apparatus according to the present invention.

FIGS. 8 and 9 show still another embodiment of the automatic plug-in connecting apparatus according to the present invention. The structural parts of this embodiment which are identical with those of the previously-described automatic plug-in connecting apparatus of Example 1 are designated by the same reference numerals and the descriptions thereof are omitted. As shown in FIGS. 8 and 9, the automatic plug-in connecting apparatus is provided with a discharge port 14 in a rear wall of a reception side connecting unit so that discharge port 1A extends from receiving hollow 9 to the same rear wall, through a mount 19, for a pin contact. This apparatus is also provided with a valve body 18 supported on mount 19 for pin contact via a spring member 17. The automatic plug-in connecting apparatus is adapted to close discharge port 14 when inner cylinder 1 is forced into receiving hollow 9. The construction of the remaining parts of this embodiment is completely the same as that of the corresponding parts of the automatic plug-in connecting apparatus in Example 1. The automatic plug-in connecting apparatus of this embodiment produces an effect identical with that of the previously-described Example 1. Additionally, this embodiment is capable of expanding the range of the clean gas atmosphere to a space in which a contact 12 and an electric wire are connected together. This structure meets the requirements for a sealed type pressurized type explosion-protected construction, and may also be used as a ventilated type pressurized type explosion-protected construction by omitting spring member 17 and valve body 18.

Figure 10:
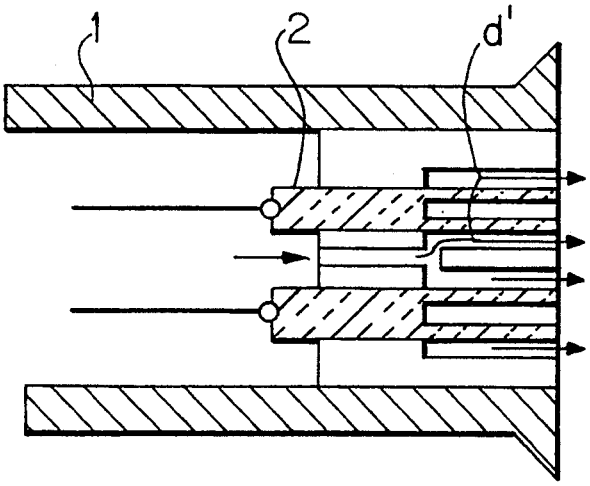
FIG. 10 is an enlarged sectional view of a socket contact; this drawing being prepared for illustrating a first modified example of the inert gas introducing means shown in FIG. 3.
Figure 11:
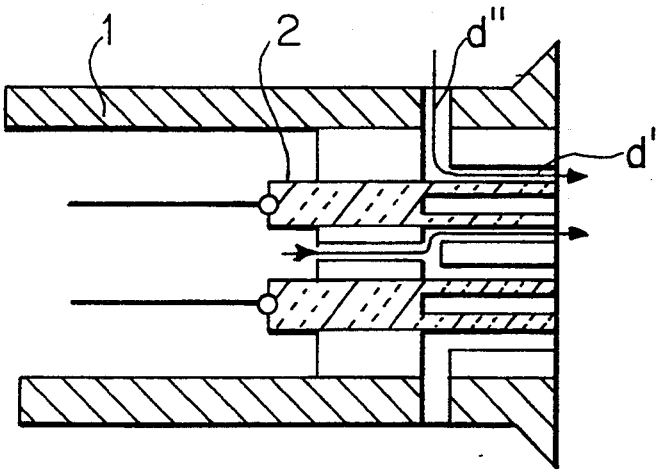
FIG. 11 is an enlarged sectional view of a socket contact; this drawing being prepared for illustrating a second modified example of the clean gas introducing means shown in FIG. 3.

The above-described embodiment of FIGS. 8 and 9 uses a socket contact 2 provided with an air vent d extending through the interior thereof but socket contact a is not limited to a socket contact thus formed. For example, when socket contact 2 is so thin that air vent d cannot be conveniently provided, socket contact 2 having air vents d' therearound, as shown in FIG. 10, may be used. Also, as shown in FIG. 11, an air vent d" may be provided in addition to air vents formed as shown in FIG. 10, in the side wall of the inner cylinder. This structure is used effectively when it is necessary to reduce the time taken to turn the interior of receiving hollow 9 into a clean gas atmosphere, and a combination of this structure with the socket contact of FIG. 3, which is used in Examples 1 and 2, also displays the same effect.

The above-described four embodiments use a limit switch as a detector in the connection detecting means. Such a detector is not limited to a limit switch; for example, a proximity switch or photoelectric switch may also be used.

The ascertaining of connection of socket contact 2 to pin contact 12 may also be accomplished by detecting variation of pressure, which occurs when the discharge port 14 is closed, detected by supplied clean gas detecting means F.

The above-described four embodiments use a means for detecting the internal pressure of the inner cylinder as the supplied clean gas detecting means but such means for detecting are not limited to the former. For example, a means for detecting the flow rate of the clean gas may also be used.

According to the present invention described above, a clean gas is supplied to the inner cylinder with the air vent of the socket contact used as a discharge port during an operation for connecting the socket contact and pin contact together by combining the supply side connecting unit with the reception side connecting unit. Thus, the space around the socket contact may be kept in a clean gas atmosphere. Since this combining operations is carried out in a power-off condition, the safety of the operation is very high.

The automatic plug-in connecting apparatus according to the present invention is provided with an engagement guide consisting of a flange, formed at the base end portion of the outer cylinder; a second flange, formed at the fitting mouth portion of the recessed faucet joint of the reception side connecting unit and opposed to the flange of the outer cylinder; guide pins formed on either one of these flanges; and pin receiving bores formed in the flange on which the guide pins are not formed. Therefore, when an operation for combining the supply side connecting unit with the reception side connecting unit is carried out, the guide pins are inserted into the pin receiving bores. Additionally, the axes of the projecting and recessed faucet joints are aligned, so that the faucet joint engaging and disengaging operations may be carried out smoothly and reliably.

The automatic plug-in connecting apparatus according to the present invention is also provided with a connection detecting means, for ascertaining the combining of the supply side connecting unit with the reception side connecting unit; a supplied clean gas detecting means, adapted to sense the presence or absence of a clean gas supplied to the interior of the inner cylinder; and a current supply control means, for controlling the supply of an electric current from a power source after confirmation of the operations of the connection detecting means and supplied clean gas detecting means. Therefore, even while the contacts are connected together (electric current is supplied), the pressure in the connecting apparatus may be kept higher than that of the outside atmosphere, and the entry of an explosive gas into the interior of the connecting apparatus is prevented. Thus, the space around the contacts may always be kept in a clean gas atmosphere. Accordingly, if the outside environment of the apparatus is an explosive gas atmosphere, an electric current may be supplied very safely. Since it is possible to constantly ascertain, by the supplied clean gas detecting means, that a clean gas continues to be supplied to the space around the contacts, this apparatus may be operated very safely. Additionally, the supply of an electric current is stopped immediately by the current supply control means when the supply of a clean gas is discontinued.

Moreover, when this apparatus is modified to a sealed type, the quantity of the clean gas consumed during the connection of the contacts (supplying of an electric current) may be minimized. Therefore, this apparatus may be used very economically.

What is claimed is:

1. An automatic plug-in connecting apparatus comprising:

a supply side connecting unit provided with an electrical connecting socket contact buried at a distal end of said supply side connecting unit and said electrical connecting socket serving also as an air vent, and at a proximal end portion of said supply side connecting unit an outlet port is provided for taking out therefrom an electric wire connected to said socket contact and an inlet port is provided in said supply side connecting unit for introducing a non-explosive inert gas thereinto;

a reception side connecting unit is provided with a hollow, disposed at a distal end of said reception side connecting unit, for receiving said supply side connecting unit, and at a distal end portion of said receiving hollow, a discharge port is provided for discharging therefrom a gas in said receiving hollow and a space communicating therewith and a pin contact is provided for forming a counterpart of said socket contact;

a supply side connecting unit driving means for fitting said supply side connecting unit into said receiving hollow of said reception side connecting unit so as to connect or disconnect said socket contact and said pin contact to or from each other, an engagement guide which consists of guide pins provided on either one of said supply side connecting unit and said reception side connecting unit or pin receiving bores provided in the other thereof, said engagement guide for facilitating an operation for fitting said supply side connecting unit into said receiving hollow of said reception side connecting unit, an inert gas supply means for forming an inert gas atmosphere in a space in the vicinity of said socket contact and said pin contact when said contacts are connected and disconnected to and from each other by connecting said supply side connecting unit to said reception side connecting unit, a connection detecting means for ascertaining the connection of said supply side connecting unit to said reception side connecting unit, a supplied inert gas detecting means adapted to sense the presence or absence of said inert gas supplied to an interior of said supply side connecting unit, and a current supply control means operatively connected to said connection detection means and said supplied inert gas detecting means and adapted to control a supply of electric current from a power source.

2. An automatic plug-in connecting apparatus according to claim 1, wherein said supply side connecting unit consists of an inner cylinder provided at one end portion thereof with said electrical connecting socket contact buried therein and serving also as said air vent, and at a distal end thereof with said outlet port for removing therefrom said electric wire connected to said socket contact and said inlet port for introducing a non-explosive inert gas there-into; an outer cylinder having a length smaller than that of said inner cylinder, fitted around said inner cylinder so that said inner cylinder is slidingly movable in a lengthwise direction, said outer cylinder having a flange at a base end portion thereof and forming a projecting joint at a free end portion thereof; a spring member provided on an outer circumferential surface of said inner cylinder and adapted to apply, to said flange, stress directed from said base end of said outer cylinder to said free end portion thereof, so as to keep an outer end surface of said socket contact and a corresponding end surface of said projecting joint of said outer cylinder flush with each other; and said reception side connecting unit provided with a recessed joint engageable with said projecting joint of said outer cylinder, a receiving hollow formed continuously from and at the back of a joint-engaging direction of said recessed joint and adapted to receive said inner cylinder forced out from said outer cylinder, a discharge port formed in a wall of said receiving hollow so as to discharge therefrom said inert gas in said receiving hollow and a space communicating therewith, and said pin contact formed in said receiving hollow and constituting a counterpart of said socket contact in said inner cylinder.

3. An automatic plug-in connecting apparatus according to claim 1, wherein said apparatus further includes a means for closing said discharge port at a time of completion of the connection of said socket contact with said pin contact so as to turn said receiving hollow to a closed space.

4. An automatic plug-in connecting apparatus according to claim 2, wherein said engagement guide consists of said outer cylinder which has a frusto-conical projecting joint, and which also services as said guide pin; and said reception side connecting unit which has a cone-shaped recessed joint engageable with said projecting joint of said outer cylinder, and which serves also as said guide pin receiver.

5. An automatic plug-in connecting apparatus according to claim 1, wherein said reception side connecting unit is provided at a distal end thereof with said receiving hollow for receiving said supply side connecting unit, said pin contact positioned at the back of said receiving hollow and forming a counterpart of said socket contact in said supply side connecting unit, and said air vent formed at a pin contact fixing portion of said reception side connecting unit, and at the other end portion thereof with said outlet port for taking out therefrom said electric wire connected to said pin contact, and a discharge port for discharging therefrom a non-explosive inert gas supplied from said supply side connecting unit.

6. An automatic plug-in connecting apparatus according to claim 1, wherein said vent for said inert gas is provided around said socket contact.

* * * * *